US006911248B2

(12) United States Patent
Sabatini

(10) Patent No.: US 6,911,248 B2
(45) Date of Patent: Jun. 28, 2005

(54) COMPOSITE PANEL FOR SUPERELEVATED FLOORS

(75) Inventor: Marco Sabatini, Nuvolera (IT)

(73) Assignee: Bresciana Graniti S.p.A. (IT)

( * ) Notice: Subject to any disclaimer, the term of this patent is extended or adjusted under 35 U.S.C. 154(b) by 365 days.

(21) Appl. No.: 10/273,477

(22) Filed: Oct. 18, 2002

(65) Prior Publication Data

US 2003/0097808 A1 May 29, 2003

(30) Foreign Application Priority Data

Oct. 18, 2001 (EP) ..... 01830658

(51) Int. Cl.[7] ..... B32B 3/02

(52) U.S. Cl. ..... 428/119; 428/44; 428/45; 428/49; 428/121; 428/157; 428/164

(58) Field of Search ..... 428/44, 45, 49, 428/119, 121, 157, 164; 404/44, 45; 52/792.1, 800.11

(56) References Cited

U.S. PATENT DOCUMENTS 4,447,998 A 5/1984 Griffin
4,944,130 A 7/1990 Pallhorn

FOREIGN PATENT DOCUMENTS

DE 8106740.2 U1 8/1981
WO WO-99/18305 A1 4/1999

*Primary Examiner*—Alexander S. Thomas
(74) *Attorney, Agent, or Firm*—Akerman Senterfitt

(57) ABSTRACT

The invention relates to a composite panel for raised floors comprising a core bonded on its top to a tile of stony material and bonded on its bottom to a base of metallic material, wherein the stony material tile has a bottom surface comprising a peripheral portion and a central portion, and has a perimeter recess formed at the bottom surface, wherein the core is bonded to the stony material tile through the central portion of the bottom surface, and wherein the base of metallic material consists of a metallic sheet having upturned edges to form a tray that is bonded to the core, the end portions of the upturned edges being folded up to bond the stony material tile at the peripheral portion of its bottom surface and in the perimeter recess.

10 Claims, 3 Drawing Sheets

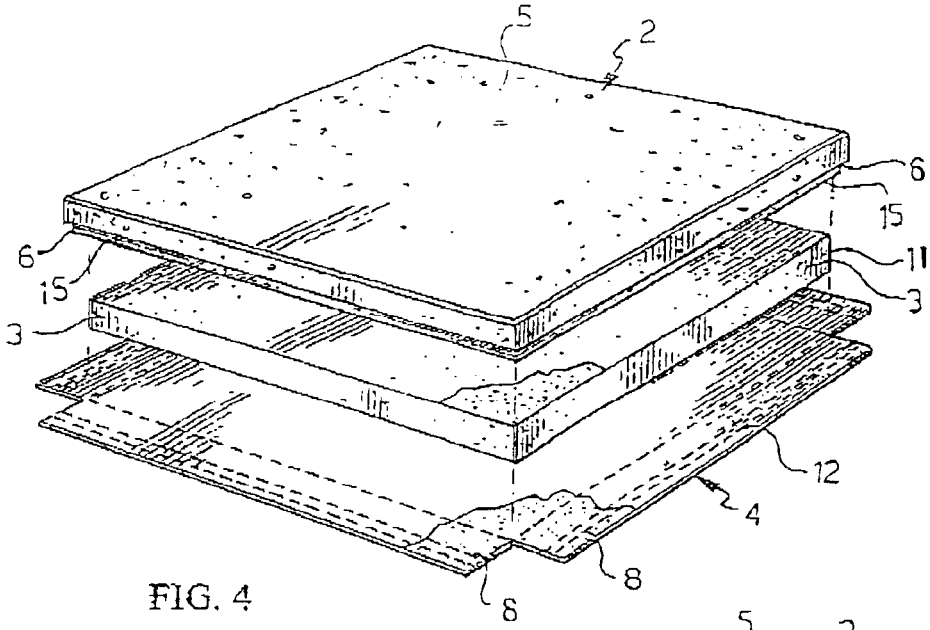
FIG. 4
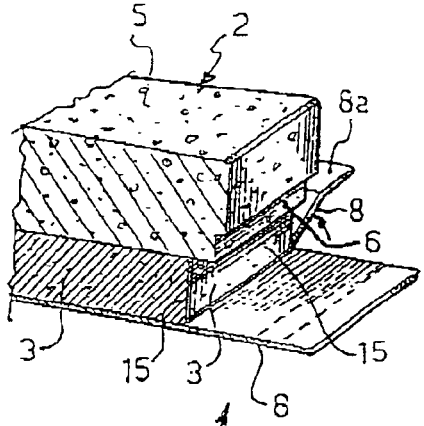
FIG. 6
FIG. 5
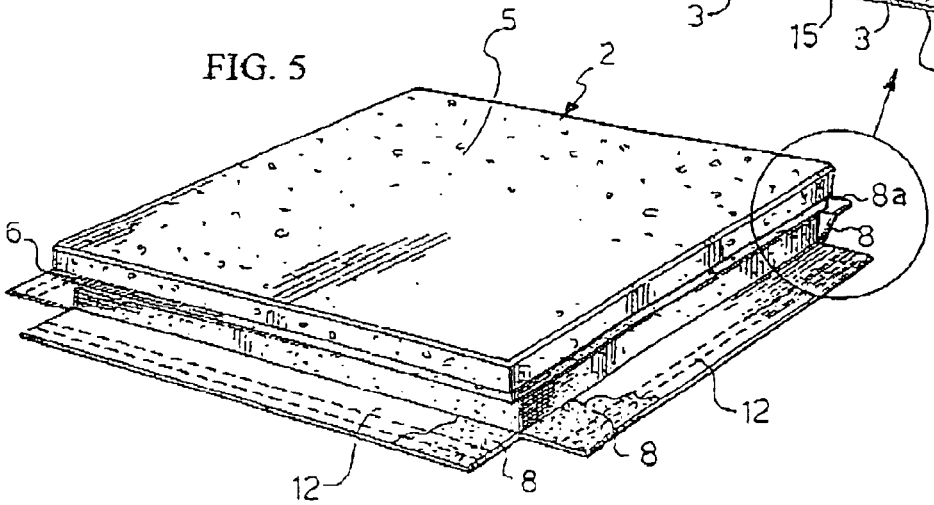

FIG. 8
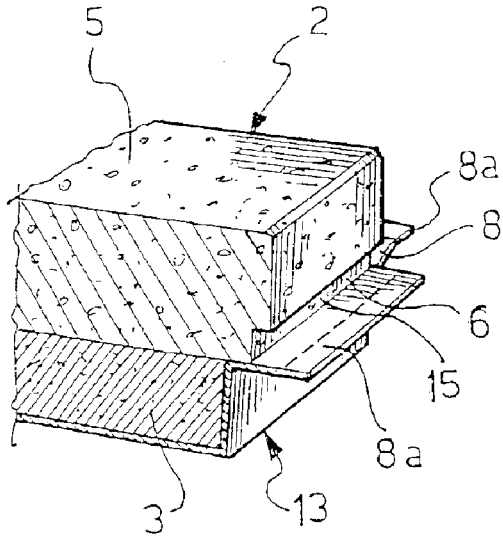
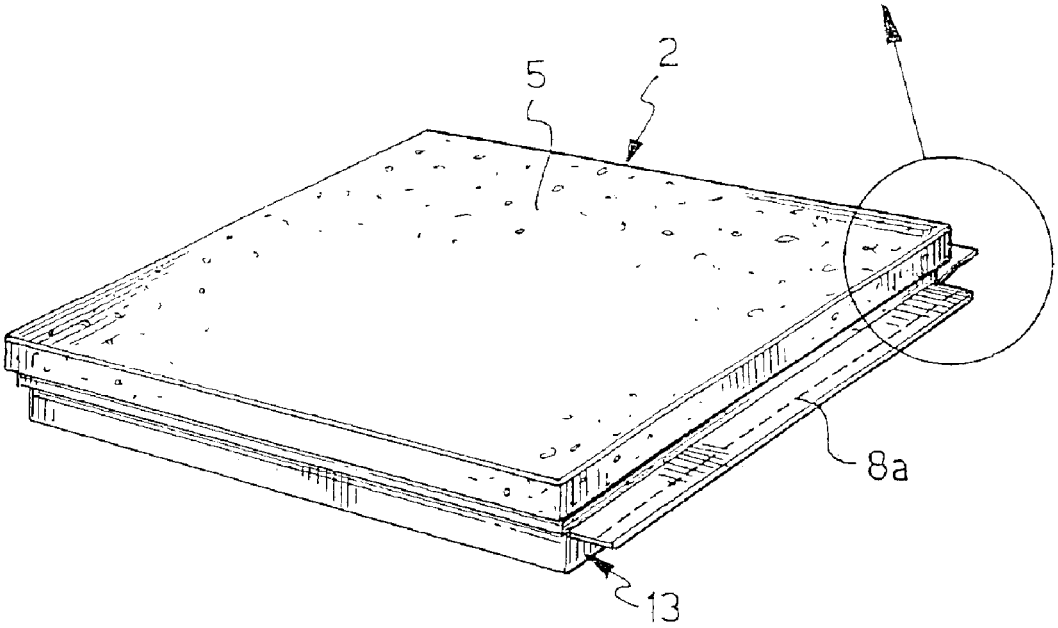
FIG. 7

COMPOSITE PANEL FOR SUPERELEVATED FLOORS

DESCRIPTION

1. Field of Application

The present invention relates to the building industry.

In particular, the invention relates to a modular composite panel for raised floors.

2. Prior Art

The raised floor was introduced in the 1960s to provide suitable flooring for areas devoted to data processing equipment, and was made up of standard size (usually 60×60 cm) panels laid onto a base structure of metal that was arranged to rest directly on the floor foundation and could be adjusted in height. This construction left a space under the tread surface where raceways for cables and coolant ducts could be laid as required for the data processors of the time.

The floor panels were a ply construction obtained by gluing, onto a chipboard core, a synthetic sheet lining (linoleum, Formica or PVC) provided to form the tread side of the panel. These panels were simply positioned onto the metal base structure and held in place by reason of their accurate mutual fit, like pieces of a jigsaw puzzle. Whenever required for system inspection and maintenance purposes, one or more panels could be lifted off using suction cups.

As the modern computers became more compact, the data processing centres went out of fashion, and the manufacturers of raised floor systems were left with the problem of finding fresh outlets for their production. Most attractive of these new applications has shown to be the use of raised floors for technological spaces instead of false ceilings, because of the more convenient access that raised floors afford for system maintenance and layout modification purposes.

Thus, the utilization of raised floors has expanded to include banks, office premises, and hotels, because it combines general comfort with flexibility of installation and ready accessibility for servicing.

New modular elements have kept adding to the original linoleum or plastics tread panels which are covered with more precious materials, such as wood, carpet, ceramics, or natural stone, thereby opening new prospects for the application of raised floors.

Unfortunately, the introduction of these new materials has also put forward the limitations of the chipboard core, especially as regards flame resistance and loading capacity.

Thus, new floor panels have been developed which use cores of inert materials based on aggregates of gypsum and cellulose fiber, which are pressed by a similar process as plasterboard. Panels formed by coupling these cores with the aforementioned tread materials exhibit greater inertia and rigidity, as well as improved dimensional stability and flame resistance compared to the chipboard types. However, these panels tend to be cost-intensive, and they are heavier and affected by contact with water due to the use of a binder, i.e. gypsum, that is not water-resistant, and of cellulose.

Panels having cores based on calcium silicate have also been proposed which have similar properties to those having cores based on gypsum.

Finally, panels having cores based on cement, lightweight inert materials, and polymer fiber have been proposed which are more cost-efficient than gypsum cored panels and are unaffected by water, but they are heavier and less stable dimensionally.

The above panels, whether comprising a chipboard core or one of gypsum, calcium silicate, or cement, are finished with a backing piece of sheet metal (aluminum or zinc-galvanized steel) on their underside, and are approximately 36–42 mm thick.

Substantially two bonding operations are necessary to make the above panels: at first the tread surface material (granite or marble tile, ceramics, wood, etc.) is bonded to the core by means of an adhesive, and then the backing piece of sheet metal is bonded to the core underside again by means of the adhesive.

The panels formed with gypsum-, silicate-, or cement-based cores, especially those covered with materials of naturally occurring or man-made stone, are satisfactory as to mechanical strength (ultimate strength) and flame resistance, but they have drawbacks that are at the root of the still limited acceptance of raised floors.

A major drawback of such panels is that, in order to have satisfactory mechanical performances, their sandwich structure must have a substantial total thickness dimension (36 to 42 mm), so complicating the storage and transport of the panels.

Furthermore, the panel is inadequately protected against moisture, which might reduce the bonding efficacy along time, then causing delamination of the panel components. This may occur during storage or after installation of the finished panels, or result from the floor being washed with too much water.

The substantial weight of the finished panels, along with the brittle nature of the tread material and the core, can also render difficult load, transport, and unload operations and the installation procedure on the site of application. Difficulty is encountered, moreover, when one or more panels require to be removed for inspecting and servicing systems.

The underlying problem of this invention is to provide a novel composite panel for raised floors, which can overcome the aforementioned drawbacks of the prior art.

SUMMARY OF THE INVENTION

The problem is solved by this invention providing a composite panel according to claim 1 and followings. More particularly, the problem is solved by a composite panel for raised floors, which comprises a core bonded on its top to a tile of stony material and bonded on its bottom to a base of metallic material, characterized in that the stony material tile has a bottom surface comprising a peripheral portion and a central portion, and has a perimeter recess formed at the bottom surface, in that the core is bonded to the stony material tile through the central portion of the bottom surface, and in that the base of metallic material consists of a metallic sheet having upturned edges to form a tray that is bonded to the core, the end portions of the upturned edges being folded up to bond the stony material tile at the peripheral portion of its bottom surface and in the perimeter recess.

The thickness of the stony material tile is comprised within the range of 13 to 20 mm, and is preferably about 17 mm. The tile contour shape is preferably square and is typically 60 cm long on the side.

The stony material is preferably chosen between granite and marble.

The core preferably consists of an inert material formed from an aggregate of gypsum and cellulose fiber. The core thickness is generally comprised within the range of 12 to 36 mm, and is preferably about 12.5 mm.

The base of metallic material preferably consists of a zinc-galvanized sheet having edges and a thickness generally comprised within the range of 0.5 to 1.0 mm, preferably about 0.8 mm. Thus, the total thickness of the composite panel according to the invention will vary between 26 and 57 mm, and be preferably 30.3 mm when the stony material tile is 17 mm thick.

According to the invention, the edges of the above mentioned metallic sheet are turned up to form a tray which dimensions substantially equal those of the core, such that the core can fit comfortably in said tray. In addition, the end portions of the upturned edges are folded up in such a way to bond around the stony material tile at the peripheral portion of its bottom surface and in the perimeter recess.

The folding up of the end portions of the upturned edges of the metallic sheet allows to form an housing for the stony material tile, the housing being a second tray which covers a portion of the stony material tile delimited by the peripheral portion of its bottom surface and the perimeter recess. Advantageously, this second tray holds the stony material tile firmly in place and protects it against side forces, thereby facilitating loading, transport and unloading of the composite panels according to the invention. The rate of installation of the panels on the application site is also considerably improved.

In addition, the composite panel of this invention is better protected from moisture seepage than conventional panels by virtue of the particular shape of the metallic shape with its upturned and folded up edges, which enclose the core and a portion of the stony material tile. Accordingly, in the panel of this invention, the risk of delamination of the component parts is strongly reduced or totally avoided either in storage or after installation on the application site or when the floor is washed with too much water.

The bonding between the stony material tile and the metallic sheet with upturned and folded up edges, and the bonding between the folded up end portions of the upturned edges and the stony material tile are performed by means of an adhesive.

The adhesive is preferably a two-components polyurethane glue comprising a glue and a hardener. A preferred commercially available product is Resinlux 100/S MMB for the glue and CTZ 100/S MMB for the hardener.

The panel of this invention is further characterized in that, for a smaller thickness than that of a corresponding conventional panel, it surprisingly features mechanical strength at least comparable with that of the conventional panel. In addition, The flame resistance characteristics of the panel according to the invention are totally comparable to those of conventional panels.

The reduction of thickness attainable with the panels according to the invention reflects in correspondent reduction of the panel weight, thereby making easier and cost-efficient the storage and transport of the panels. Also, the installation of the panels is considerably facilitated and quick, thereby labour cost are reduced. Finally, inspection operations after installation of the raised floor will be easier and safer to perform.

Further advantages of the panel according to the invention will be apparent from the following description of an embodiment thereof, given by way of a non-limiting example with reference to the accompanying drawings.

BRIEF DESCRIPTION OF THE DRAWINGS

FIG. 4 is an exploded perspective view of a composite panel according to the invention;

FIG. 5 is a perspective view of a composite panel according to the invention at one stage of its manufacture;

FIG. 6 is an enlarged view of a detail of the composite panel shown in FIG. 5;

FIG. 7 is a perspective view of a composite panel according to the invention at another stage of its manufacture; and FIG. 8 is an enlarged view of a detail of the composite panel shown in FIG. 7.

DETAILED DESCRIPTION

Figure 1:
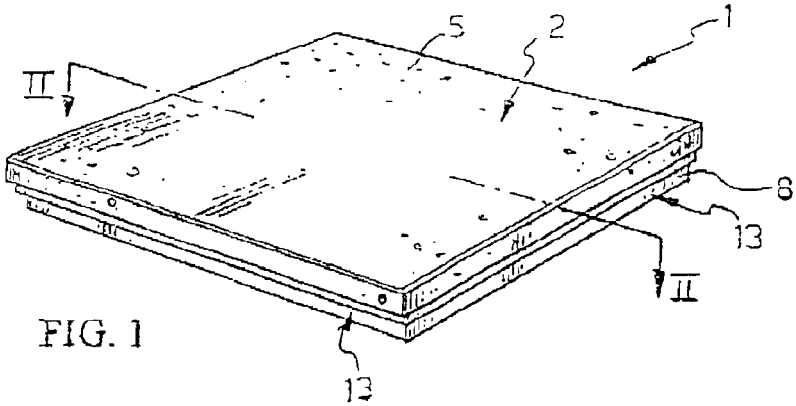
FIG. 1 is a perspective view of a composite panel according to the invention.
Figure 2:
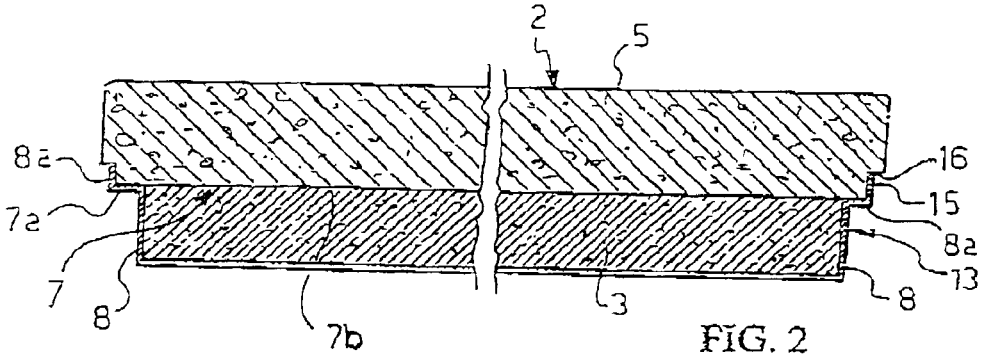
FIG. 2 is a cross-sectional view of the composite panel shown in FIG. 1, taken along line II—II.

With reference to the above drawings, a composite panel 1 for raised floors according to the invention comprises a tile 2 of a stony material, which has a square contour shape and is bonded by means of an adhesive layer 11 to a core 3 consisting of a gypsum/cellulose fiber aggregate. This core is in turn bonded to a base 4 of metallic material by means of another adhesive layer 12.

Preferably, the adhesive consists of a two-part polyurethane glue.

In particular, the tile 2 has a top tread surface 5 and an opposed bottom surface 7 on which a perimeter recess 6 is formed, the perimeter recess 6 having a substantially "L" profile delimited by a substantially vertical lower wall 15 and a substantially horizontal upper wall 16, the latter wall being the smaller one.

Preferably, the edges of the stony material tile 2 are beveled on the top tread surface 5.

The bottom surface 7 has a small peripheral portion 7*a* and a central portion 7*b* bonded to the core 3 by the adhesive layer 11.

In general, the peripheral portion 7*a* of the bottom surface 7 is 2 to 5 mm wide, and the lower wall 15 of the recess is 4 to 6 mm high.

The base 4 is obtained from a zinc-galvanized steel sheet and has upturned edges 8 forming a tray 13 that has substantially the same dimensions as the core 8, so that the core will fit inside the tray 13 for bonding thereto.

End portions 8*a* of the upturned edges 8 are folded up in such a way to bond to the stony material tile 2 at the peripheral portion 7*a* of the bottom surface 7 and engage in the peripheral recess 6 of the stony material tile 2.

In the embodiment shown, the end portions 8*a* of the upturned edges 8 are bonded throughout to the lower surface 15 of the perimeter recess 6 by the adhesive layer 12, and define a second tray effective to receive and hold the stony material tile 2 in place. This construction provides the panel 1 of this invention with improved protection from water seepage, which could adversely affect the bonding efficacy of the adhesive layers 11 and 12.

Figure 3:
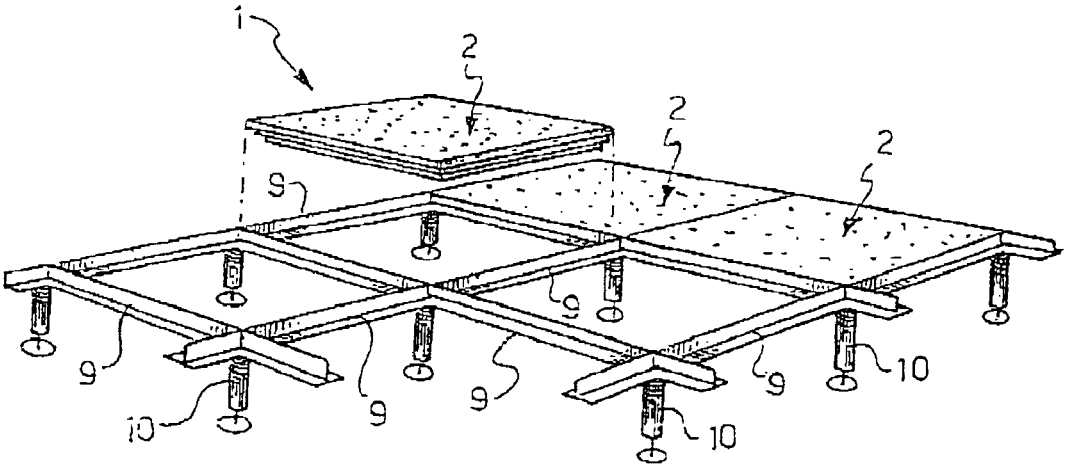
FIG. 3 is a schematic perspective view of a portion of a raised floor comprising composite panels according to the invention.

FIG. 3 shows a portion of a raised floor, in which two composite panels according to the invention have been laid onto a conventional supporting structure 8 formed of joists 9 and uprights 10.

It will be appreciated that the composite panels according to the invention can be laid easily and quickly because the sheet 4 protects the core 3 and the stony material tile 2 from shocks, especially sideward applied ones, by its upturned edges 8 and offset edge portions 8*a*, respectively.

The manufacturing process of the panel according to the invention (FIGS. 4–8) includes conventionally fretting the edges of the stony material tile 2 around its bottom surface 7 to form the perimeter recess 6. Also, the edges of the stony material tile 2 are optionally beveled in a conventional way.

Then, the core 3 of gypsum and cellulose fiber is bonded by the adhesive layer 12 to the sheet 4, while the latter is still in its flat expanded state. The adhesive layer may be spread preliminarily either onto the sheet 4 (as shown in FIG. 4) or on the surface of the core 3 that is to be bonded to the sheet 4.

Thereafter, the tile 2 is laid with its bottom surface 7 onto the core 3, provided that an adhesive layer 11 is applied for example on the surface of the core 3 to be bonded to the tile 2.

In particular, the tile 2 is laid such that the adhesive layer 11 will establish a bonding between the central portion 7*b* of the bottom surface 7 and the core 3, the dimensions of the latter being smaller than those of the stony material tile 2 as measured at the bottom surface 7.

The edges 8 of the sheet 4 are then turned up to form the tray 13, which tray is bonded to the core 3 by the adhesive layer 12, and the end portions 8*a* of the edges 8 are folded up for bonding, by the adhesive layer 12, to the peripheral portion 7*a* of the bottom surface 7 and the vertical wall 15 in the perimeter recess 6.

The mechanical strength, sound deadening property, reaction and resistance to flame of a composite panel according to the invention were measured and compared with those of a conventional composite panel.

The panel according to the invention was obtained as described hereinabove, and comprised a granite tile measuring 60×60 cm and being 17 mm thick. The tile had been previously bonded to a board, measuring 58.8×58.8 cm and being 12.5 mm thick, formed from a pressed aggregate of gypsum and cellulose fiber known in the trade as "Knauf calcium sulphate". The board was in turn bonded to a base of zinc-galvanized steel sheet 0.8 mm thick. The edges of the zinc-galvanized steel sheet were turned up 16.5 mm and their end portions were folded up to form a tray measuring 59.8×59.8 cm, the end portions being bonded to the granite tile as described hereinabove.

The bonding was effected using a commercial adhesive obtained by suitably mixing together a Resinlux 100/S MMB glue, and a CTZ 100/S MMB hardener. The total weight of the panel was 67.68 kg/m$^2$.

The comparison was a panel comprising the same granite tile (60×60 cm, 17 mm thick) bonded, using the above commercial adhesive, to a board measuring 60×60 cm and being 18 mm thick of a pressed aggregate of gypsum and cellulose fiber known in the trade as "Knauf calcium sulphate". The board was in turn bonded, by the same adhesive, to a base of zinc-galvanized steel sheet 0.5 mm thick. The total weight of the panel was 73 kg.

A series of tests involving both panels were run and the results are reported here below.

| TESTS | Panel of the invention | Comparison Panel |
|---|---|---|
| Concentrated Load | Broken under 1500 kg | Broken under 700 kg |
| Loading Class | UNI Class 3 | UNI Class 2 |
| Deflection | 2.5 mm | 2.5 mm |
| Residual Impression | none | none |
| Flame Reaction | Class 1 | Class 1 |
| Flame Resistance | REI 45 | REI 30 |
| Sound Deadening | 21 dB | 20 dB |

The above results bring out that the composite panel according to the invention, although thinner than the comparison panel, is possessed of superior mechanical strength, and of substantially comparable flame resistance, flame reaction, and sound deadening properties.

What is claimed is:

1. A composite panel for raised floors comprising a core bonded on its top to a tile of stony material and bonded on its bottom to a base of metallic material, wherein the stony material tile has a bottom surface comprising a peripheral portion and a central portion, and has a perimeter recess formed at the bottom surface, wherein the core is bonded to the stony material tile through the central portion of the bottom surface, and wherein the base of metallic material consists of a metallic sheet having upturned edges to form a tray that is bonded to the core, the end portions of the upturned edges being folded up to bond the stony material tile at the peripheral portion of its bottom surface and in the perimeter recess.

2. A composite panel according to claim 1, wherein the stony material is either marble or granite.

3. A composite panel according to claim 2, wherein the thickness of the stony material tile is comprised within the range of 13 to 20 mm, and is preferably about 17 mm.

4. A composite panel according to claim 3, wherein the contour shape of the stony material tile is preferably square and is 60 cm long on the side.

5. A composite panel according to claim 1, wherein the core consists of an inert material comprising an aggregate of gypsum and cellulose fiber.

6. A composite panel according to claim 5, wherein the thickness of the core is comprised within the range of 12 to 36 mm, preferably about 12.5 mm.

7. A composite panel according to claim 1, wherein the metallic sheet with edges is of zinc-galvanized steel and has a thickness comprised within the range of 0.5 to 1.0 mm, preferably about 0.8 mm.

8. A composite panel according to claim 1, wherein its total thickness is between 26 and 57 mm, preferably 30.3 mm when the stony material tile is 17 mm thick.

9. A composite panel according to claim 1, wherein the bonding of the core to the stony material tile and to the sheet with upturned and folded up edges, and the bonding of the end portions of the edges to the stony material tile are performed by means of an adhesive.

10. A composite panel according to claim 9, wherein the adhesive consists of a two-component polyurethane glue comprising a glue and a hardener.

* * * * *